US010254079B2

(12) United States Patent
Schneider

(10) Patent No.: US 10,254,079 B2
(45) Date of Patent: Apr. 9, 2019

(54) WEAPON WITH A BARREL CLUSTER

(71) Applicant: RHEINMETALL WAFFE MUNITION GMBH, Unterluess (DE)

(72) Inventor: Hubert Schneider, Dietingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 15/867,190

(22) Filed: Jan. 10, 2018

(65) Prior Publication Data

US 2018/0209762 A1 Jul. 26, 2018

Related U.S. Application Data

(63) Continuation of application No. PCT/EP2016/065863, filed on Jul. 5, 2016.

(30) Foreign Application Priority Data

Jul. 10, 2015 (DE) ..... 10 2015 008 796

(51) Int. Cl.

| | |
|---|---|
| ***F41F 1/10*** | (2006.01) |
| ***F41A 11/02*** | (2006.01) |
| ***F41A 17/16*** | (2006.01) |
| ***F41A 17/30*** | (2006.01) |
| ***F41A 19/18*** | (2006.01) |
| ***F41A 21/06*** | (2006.01) |
| ***F41A 21/48*** | (2006.01) |

(Continued)

(52) U.S. Cl.

CPC ..... *F41F 1/10* (2013.01); *F41A 7/06* (2013.01); *F41A 11/02* (2013.01); *F41A 17/16* (2013.01); *F41A 17/30* (2013.01); *F41A 19/18* (2013.01); *F41A 21/06* (2013.01); *F41A 21/487* (2013.01); *F41F 1/08* (2013.01)

(58) Field of Classification Search

CPC ..... F41F 1/08; F41F 1/085; F41F 1/10; F41A 7/06

USPC ..... 89/1.41, 12, 126, 127

See application file for complete search history.

(56) References Cited

U.S. PATENT DOCUMENTS

| | | | | |
|---|---|---|---|---|
| 426,015 | A | 4/1890 | Herrick | |
| 2,950,652 | A * | 8/1960 | O'Brien | F41A 9/27 42/68 |

(Continued)

FOREIGN PATENT DOCUMENTS

| | | |
|---|---|---|
| DE | 2111 060 A1 | 9/1971 |
| DE | 10 2008 018 892 A1 | 10/2008 |

(Continued)

*Primary Examiner* — Gabriel J. Klein

(74) *Attorney, Agent, or Firm* — Muncy, Geissler, Olds & Lowe, P.C.

(57) ABSTRACT

A weapon having a barrel cluster, having at least one, preferably multiple, weapon barrel(s) and having a bolt, and only one of the weapon barrels is oriented in alignment with the single bolt and interacts therewith for the purposes of firing. The barrel cluster has a front, muzzle-side barrel holder and has a rear, bolt-side barrel holder, and has, in a partial region, a control body with a control cam which is incorporated on the circumference. By way of said control cam, the barrel cluster can be adjusted as a whole and independently of the firing of the weapon. The control body is preferably electronically rotated, for which purpose a pin of the actuator engages into the control cam of the control body.

19 Claims, 4 Drawing Sheets

(51) Int. Cl.
*F41F 1/08* (2006.01)
*F41A 7/06* (2006.01)

(56) References Cited

U.S. PATENT DOCUMENTS

| | | | | | |
|---|---|---|---|---|---|
| 3,407,701 | A * | 10/1968 | Chiabrandy | F41F 1/10 | 89/12 |
| 3,698,283 | A | 10/1972 | Ashley et al. | | |
| 3,706,259 | A | 12/1972 | Ashley et al. | | |
| 4,357,774 | A | 11/1982 | Badger | | |
| 4,494,332 | A | 1/1985 | Matievich | | |
| 4,926,742 | A * | 5/1990 | Ma | F41A 9/75 | 42/49.01 |
| 7,448,306 | B2 | 11/2008 | Shipman et al. | | |
| 9,297,608 | B1 * | 3/2016 | Ma | F41B 11/89 | |
| 2006/0207418 | A1 * | 9/2006 | Burke, Jr. | F41A 7/10 | 89/12 |
| 2010/0133074 | A1 | 6/2010 | Eppe et al. | | |

FOREIGN PATENT DOCUMENTS

| | | | | |
|---|---|---|---|---|
| DE | 10 2008 063 768 | A1 | 7/2010 | |
| DE | 10 2010 017 876 | A1 | 10/2011 | |
| DE | 10 2008 015 893 | B4 | 10/2014 | |
| EP | 2518430 | A2 | 10/2012 | |
| GB | 476685 | A * | 12/1937 | F41A 21/08 |
| WO | WO-9325861 | A1 * | 12/1993 | F41A 9/26 |
| WO | WO-2004063657 | A1 * | 7/2004 | F16C 23/06 |
| WO | WO2011/046653 | A2 | 4/2011 | |

* cited by examiner

WEAPON WITH A BARREL CLUSTER

This nonprovisional application is a continuation of International Application No. PCT/EP2016/065863, which was filed on Jul. 5, 2016, and which claims priority to German Patent Application No. 10 2015 008 796.7, which was filed in Germany on Jul. 10, 2015, and which are both herein incorporated by reference.

BACKGROUND OF THE INVENTION

Field of the Invention

The present invention relates to a weapon, in particular to a small-caliber weapon, which comprises a plurality of weapon barrels which are combined to form a barrel cluster. By way of the barrel cluster a possibility is achieved for performing a desired change of barrel on site, in a manner independent of firing. The change not only minimizes the stress of the individual barrel due to firing, but increases the deployment life of the weapon. Moreover, a functional reliability of the weapon during deployment is guaranteed in an improved manner. In particular, the weapon during transportation or when not in use, respectively, can be switched to a secured position in which no weapon barrel comes to lie in front of the breech.

Description of the Background Art

In the case of machine weapons or machine guns, respectively, heating of the weapon barrel typically arises in the case of an enduring deployment, also by virtue of the high rate of fire and the high number of shots. When a specific limit temperature or shot count has been reached or exceeded, respectively, this causes inter alia wear in the weapon barrel. The weapon barrel has to be replaced.

Barrel cluster weapons are known for minimizing the wear on the individual barrels. So called barrel cluster weapons are also referred to as Gatling guns. In the case of Gatling guns, a plurality of barrels are concentrated about an axis such that said barrels rotate as a cluster. Each barrel has a dedicated breech and a dedicated firing system, for example a dedicated striking bolt. During a complete revolution of the barrel cluster the breeches are unlocked, opened and locked again. The reloading function is performed when opening and locking, wherein a round is guided into the opened breech of a barrel. The barrel is rotated further, the round is guided into the cartridge chamber and fired. In the further rotation the breech is then retracted, wherein the empty cartridge case is extracted and ejected. This process in the case of all barrels runs in a continuous manner. Each barrel dispenses one shot per revolution.

DE 10 2010 017 876 A1 discloses a multi-barrel weapon and an associated belt system. The multi-barrel weapon herein comprises six barrels which are mounted so as to be rotatable about a rotation axis in the form of a barrel cluster at the front part of the weapon. Driving here in is performed electrically. A breech part which has a plurality of striking bolts, reflecting the number of barrels, which are aligned with the barrels is functionally connected to the barrels. WO 2011/046653 A2 and U.S. Pat. No. 3,698,283 A also disclose a multi-barrel weapon. The barrel change herein is also performed in a firing-dependent manner.

A multi-barrel automatic weapon which has a plurality of weapon barrels that are constructed in a manner similar to that of a Gatling gun and are mounted so as to be rotatable about a common axis is described in DE 2 111 060 A1. The advantage of this type of weapon here in lies in that the firing stress for the individual barrel is minimized in particular in the case of continuous firing and is divided among all barrels. The advantage of DE 2 111 060 A1 is that ammunition without a case can also be fired.

SUMMARY OF THE INVENTION

It is therefore an object of the present invention to provide a type of barrel cluster having a plurality of, preferably three, weapon barrels, in particular for a small-caliber weapon. After a comparatively long stress on one of the weapon barrels by firing, for example, another weapon barrel is moved in front of the breech by way of a barrel changing installation which interacts functionally with a control curve of the barrel cluster, in a manner independent of firing per se. On account thereof, the stressed and heated weapon barrel can be replaced by another. This is performed by a simple rotation of the weapon barrels within a special holder on the weapon or a weapon housing for the weapon barrels, respectively.

Guide curves for revolver weapons are known to a person skilled in the art. DE 10 2008 018 892 B3, which corresponds to US 2010/0133074, which is incorporated herein by reference, thus discloses a revolver weapon which comprises a weapon barrel and a revolver having a plurality of cartridge chambers located therein. The cartridges are supplied in a step-by-step manner to the weapon barrel by way of the revolver. The functional control for supplying ammunition by way of the revolver is incorporated on the circumference as a revolver coupling in the form of a guide curve. The revolver per se is rotated by way of a switching slide which is in multiple parts and is guided by way of a control curve on the weapon.

A revolver coupling with a guide curve is also disclosed in DE 10 2008 015 893 B4. This guide curve is distinguished in that said guide curve is embodied as a split guide curve. On account thereof, the length of the revolver can be reduced. DE 10 2008 063 768 B4, which is incorporated herein by reference, discloses a revolver and ammunition drive having a control element that is disposed about a weapon barrel. An external drive herein is functionally connected to the control curve. An entrainment element herein engages in the control curve by way of which the rotation of the revolver takes place when the entrainment element within the control curve is guided forward in the firing direction.

The barrel change, or the readjustment of the individual barrel, respectively, per se according to the invention can be performed by an operator or automatically. In the case of an automatic change, the shot count from which the stress on the current weapon barrel can be derived can be considered. A rotation of the weapon barrel can be performed when a pre-definable firing stress is detected, for example by way of a shot counter (EP 2 518 430 A2). Alternatives, such as, for example, temperature sensors etc., which are attached to the weapon barrels and trigger a signal when a predefined temperature on the weapon barrel is exceeded are conceivable. The firing operation of the weapon can then be interrupted and the barrel change can be performed.

For this task, the barrel cluster is not only mounted in a particular mounting but is also held so as to be rotationally movable therein. This mounting is distinguished by a front stationary bezel and a rear stationary bezel which in each case have a foldable, removable, or pivotable upper part. Slide rollers which facilitate a rotation of the barrel cluster are incorporated in these bezels. By contrast to the solution in U.S. Pat. No. 7,448,306 B2, this construction permits simple changing of the weapon barrels in their entirety as a barrel cluster. U.S. Pat. No. 7,448,306 B2 discloses a holder for a grenade launcher which comprises screw-fittable brackets.

The weapon barrels in turn are preferably incorporated in a common holder which in a manner similar to that of a revolver has a control element in a part region on the circumference. In one preferred embodiment, the weapon barrels are fixedly plug-fitted in the holder or in the barrel cluster, respectively, and braced such that said weapon barrels are also individually replaceable in simpler manner.

The front portion of the weapon barrel mounting/holder is provided with an internal diameter that is larger than the weapon barrel(s) to be mounted. One bearing part having a slot in the front region of the bearing part is incorporated per weapon barrel in this portion, said bearing part enclosing the weapon barrel in the region of the weapon barrel mounting. A certain resilience is achieved by way of this construction such that the expansion of the weapon barrel that is caused by the increase in temperature in the weapon barrel can be better performed by way of the bearing part. The barrel mounting on account thereof permits an adaptation in terms of length and diameter. More details pertaining thereto will be described in a parallel application of the applicant, reference to said parallel application being made herewith.

The present construction of the holder of the barrel cluster also enables only one or two weapon barrels to be received with the same basic geometry, said one or two weapon barrels being able to be supported by the holder and be rotated in the mounting. Different customer requirements, in particular in terms of the overall weight of the weapon, can thus be individually considered and the weapon can be varied in a customer-dependent manner.

A further advantage of the aforementioned barrel cluster weapon is safe transportation, since the weapon barrels in their entirety can be adjusted for transportation such that none of the weapon barrels lies in front of the breech or is aligned with said breech, respectively.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
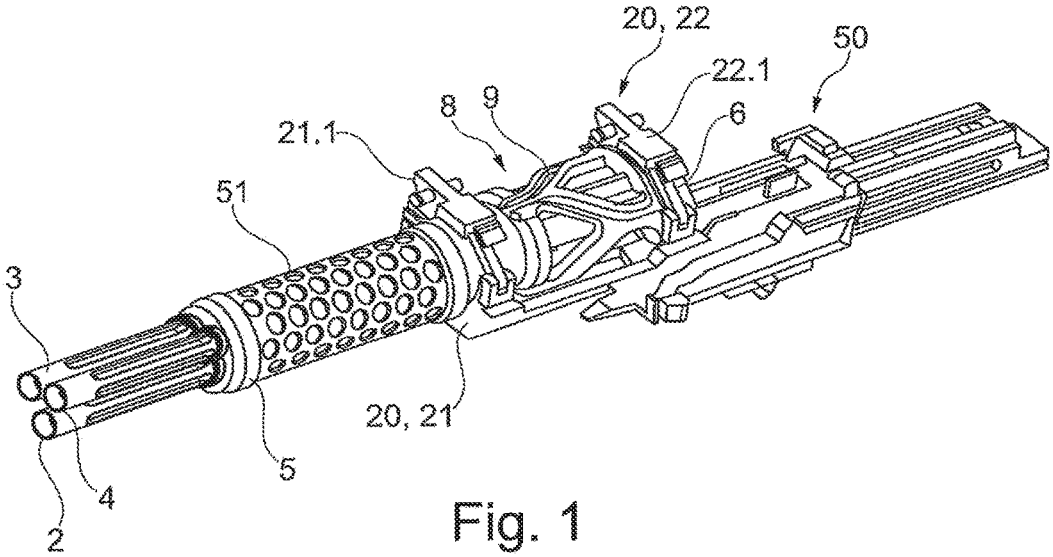
FIG. 1 shows a barrel cluster according to the invention, having a holder, in a perspective illustration.

A barrel cluster, presently having three weapon barrels 2, 3, 4 of a weapon 100 having a breech 50 is identified with the reference sign 1. The barrel cluster 1 comprises a front muzzle-side barrel holder 5 and a rear breech-side barrel holder 6. Only one weapon barrel 2 (3, 4) at the breech-side in the weapon 100 herein is aligned with the breech 50, this typically being the lower weapon barrel, that is to say the weapon barrel that is located below the two other weapon barrels 3, 4 that are located beside one another. This weapon barrel 2 is aligned with this breech 50 and also in terms of firing interacts with the breech 50 only in this position.

The barrel cluster 1 in a part region has a control element 8 having a control curve 9 which in turn is incorporated in the control element 8 on the circumference. The barrel cluster 1 in its entirety can be adjusted by way of this control curve 9 and a barrel change can thus be performed in a manner independent of firing the weapon 100. The control curve 10 that is incorporated on the circumference in the control element 8, or the profile of said control curve 10 such as the gradient, etc., in turn is adapted to the maximum number of weapon barrels that are insertable into the barrel cluster 1, that is to say adapted to the maximum number of weapon barrels which can be integrated in the barrel cluster 1. In the present exemplary embodiment, there are three weapon barrels 2, 3, 4 which in each case have to be rotated by an angle of 120°.

Figure 1A:
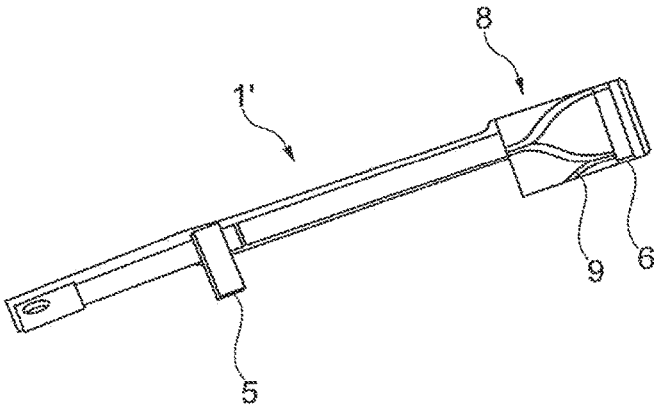
FIG. 1*a* shows a perspective illustration of the holder having only one weapon barrel.

FIG. 1*a* shows the barrel cluster V having only one weapon barrel 2. A barrel cluster having two weapon barrels 2, 3, (4) is likewise conceivable. The control curve 9 in this instance for this barrel cluster can also display a profile that is identical to that of the three weapon barrels 2, 3, 4, since the adjustment or rotation, respectively, of the barrel cluster 1 is independent of firing.

Figure 3:
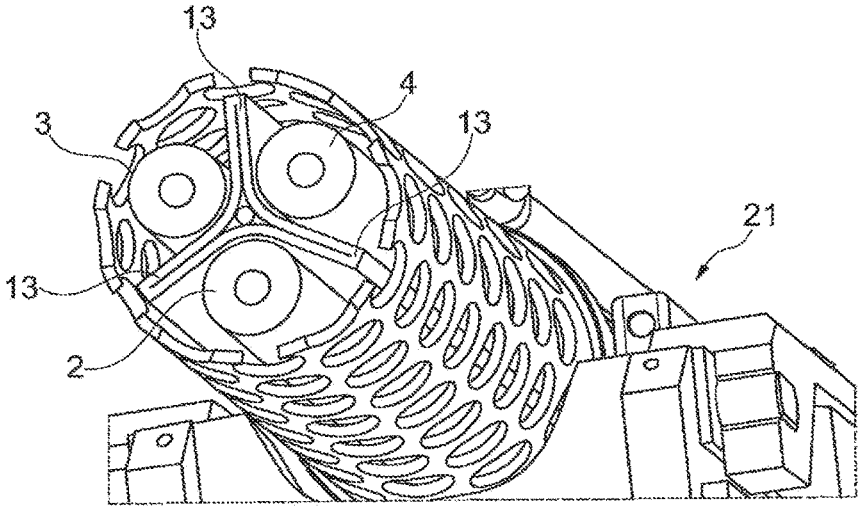
FIG. 3 shows a sectional illustration of the barrel cluster in a front view.
Figure 4:
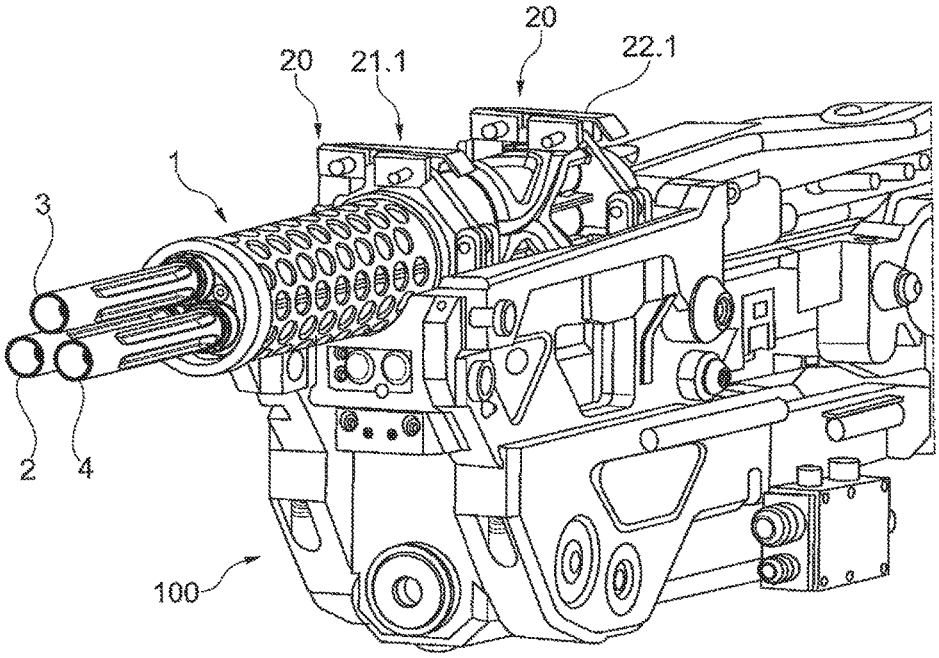
FIG. 4 shows the incorporation of the barrel cluster in a weapon.

A mounting 20 of the barrel cluster 1 (1') in general is shown in FIG. 1, said mounting 20 in this instance being incorporated in the weapon 100, FIG. 3. Both illustrations show the safe transportation position of the barrel cluster 1. None of the barrels is aligned with the breech 50.

The bearing points are formed by two stationary bezels 21, 22 which are mutually spaced apart. The spacing preferably results from the length of the control element 8. In the preferred embodiment, the bezels 21, 22 in each case have a preferably removable upper part 21.1, 22.1 in the form of a quick-release fastener. Moreover, slide rollers (not illustrated in more detail) are preferably incorporated in the bezels 21, 22.

Figure 2:
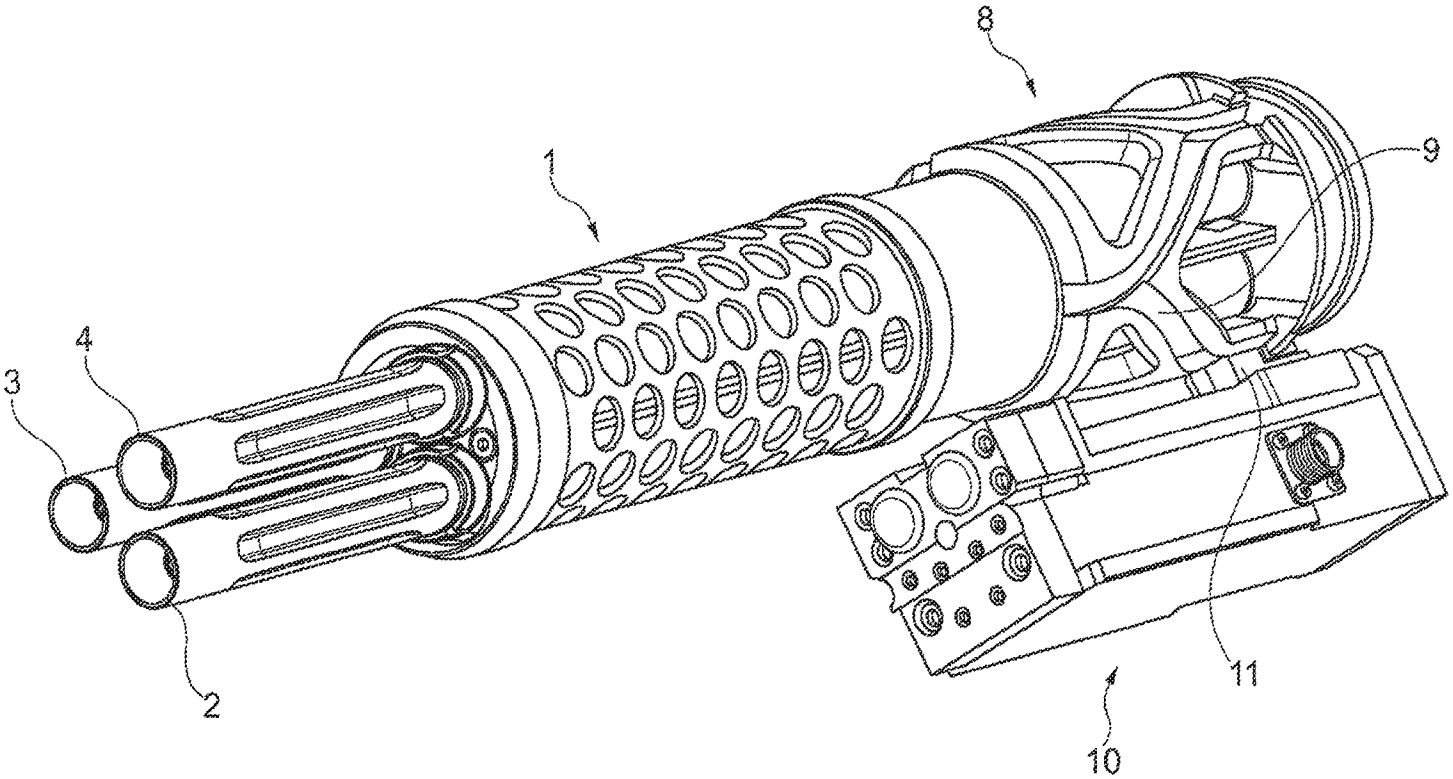
FIG. 2 shows the barrel cluster from FIG. 1, having an electric drive.

The barrel change is performed preferably electrically by way of an actuator 10 (FIG. 2), for example by way of a motor. The latter activates a bolt 11 which implements the rotation of the barrel cluster 1. The weapon barrels 2-4 then also rotate conjointly with the control element 8 such that another weapon barrel can be moved in front of the breech 5. Alternatives for changing a barrel are known to a person skilled in the art.

Plates 13 which serve for cooling the weapon barrels 2-4 (FIG. 3) can be provided between the weapon barrels 2-4. The weapon barrels 2-4 can be thermally separated from one another on account thereof. A variant that supports cooling is shown by way of incorporating a sleeve 51 that has openings and also contributes toward stabilizing the barrel cluster 1, 1'.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon having a barrel cluster, comprising:

a plurality of weapon barrels;

a breech; and a mounting, wherein only one of the plurality of weapon barrels of the barrel cluster is aligned with the breech so as to be aligned in a barrel axis, and the only one of the plurality of weapon barrels at this point in time in terms of firing interacts with the breech, and wherein bearing points of the mounting are configured by stationary, mutually spaced-apart bezels in a barrel axis direction.

2. The weapon as claimed in claim 1, wherein the barrel cluster has a front muzzle-side barrel holder and a rear breech-side barrel holder.

3. The weapon as claimed in claim 1, wherein the barrel cluster in a part region has a control element having a control curve which is incorporated in a circumference.

4. The weapon as claimed in claim 3, wherein the barrel cluster in its entirety and independently of the firing of the weapon is adjusted by way of the control curve in the control element.

5. The weapon as claimed in claim 3, wherein the control element is electronically rotated, and wherein a bolt of an actuator engages in the control curve of the control element.

6. The weapon as claimed in claim 1, wherein the barrel cluster is mounted in the mounting.

7. The weapon as claimed in claim 1, wherein the bezels have a removable upper part in the form of a quick-release fastener.

8. The weapon as claimed in claim 1, wherein slide rollers are incorporated in the bezels.

9. The weapon as claimed in claim 1, wherein cooling plates are adapted to be placed between the plurality of weapon barrels and are incorporated within the barrel cluster, said cooling plates thermally separating the the plurality of weapon barrels from one another.

10. The weapon as claimed in claim 1, further comprising a sleeve, having openings, incorporated with the barrel cluster.

11. The weapon as claimed in claim 1, wherein a front portion of the mounting is provided with an internal diameter that is larger than the barrel cluster.

12. The weapon as claimed in claim 3, wherein the control curve is adapted to a maximum number of weapon barrels integrated in the barrel cluster.

13. The weapon as claimed in claim 1, wherein the plurality of weapon barrels are configured to rotate conjointly with the control element.

14. The weapon as claimed in claim 1, wherein the plurality of weapon barrels are fixedly plug-fitted.

15. The weapon as claimed in claim 14, wherein the plurality of weapon barrels are individually replaceable.

16. The weapon as claimed in claim 1, further comprising a temperature sensor.

17. The weapon as claimed in claim 1, wherein the plurality of weapon barrels are configured to be readjusted by an operator.

18. The weapon as claimed in claim 1, wherein the plurality of weapon barrels are readjusted automatically.

19. A weapon having a barrel cluster, comprising:

a plurality of weapon barrels;

a breech, and a mounting, wherein none of the plurality weapon barrels of the barrel cluster is aligned with the breech, and none of the plurality of weapon barrels interacts with the breech before firing, and wherein bearing points of the mounting are configured by stationary, mutually spaced-apart bezels in a barrel axis direction.

* * * * *